US011300257B2

(12) United States Patent
MacPherson et al.

(10) Patent No.: US 11,300,257 B2
(45) Date of Patent: Apr. 12, 2022

(54) LED LIGHTING FIXTURE

(71) Applicant: Hubbell Limited, London (GB)

(72) Inventors: John MacPherson, Motherwell North Lanarkshire (GB); Michael Truswell, Hamilton Lanarkshire (GB); Paolo Attanasio Camillo, Uddingston Glasgow (GB)

(73) Assignee: Hubbell Limited, London (GB)

( * ) Notice: Subject to any disclaimer, the term of this patent is extended or adjusted under 35 U.S.C. 154(b) by 0 days.

(21) Appl. No.: 17/055,665

(22) PCT Filed: May 17, 2019

(86) PCT No.: PCT/GB2019/051360
§ 371 (c)(1),
(2) Date: Nov. 16, 2020

(87) PCT Pub. No.: WO2019/220132
PCT Pub. Date: Nov. 21, 2019

(65) Prior Publication Data

US 2021/0199255 A1 Jul. 1, 2021

(30) Foreign Application Priority Data

May 18, 2018 (GB) ..... 1808092

(51) Int. Cl.
*F21S 4/28* (2016.01)
*F21K 9/60* (2016.01)
(Continued)

(52) U.S. Cl.
CPC ..... *F21S 4/28* (2016.01); *F21K 9/60* (2016.08); *F21Y 2105/16* (2016.08); *F21Y 2115/10* (2016.08)

(58) Field of Classification Search
CPC .... F21S 4/28; F21S 2/005; F21K 9/60; F21Y 2105/16; F21Y 2115/10; F21V 5/007; F21V 23/003
See application file for complete search history.

(56) References Cited

U.S. PATENT DOCUMENTS 9,016,892 B1 * 4/2015 Scribante ..... F21V 17/002 362/222
2010/0277920 A1 * 11/2010 Choi ..... F21S 2/005 362/249.06

(Continued)

FOREIGN PATENT DOCUMENTS

| | | |
|---|---|---|
| CN | 202580988 U | 12/2012 |
| EP | 2327930 | 6/2011 |
| WO | 2016123210 | 8/2016 |

OTHER PUBLICATIONS

English machine translation of LIN CN 202580988, published May 21, 2012 (Year: 2012).*

(Continued)

*Primary Examiner* — Evan P Dzierzynski
(74) *Attorney, Agent, or Firm* — Michael Best & Friedrich LLP

(57) ABSTRACT

A modular lighting fixture includes a modular housing portion and one or more separate modular lighting components arranged adjacent to the modular housing portion. The separate modular lighting component(s) can include a lighting assembly having a plurality of LED devices and a plurality of optics. Each optic is secured relative to one of the plurality of LED devices. The lighting fixture also includes at least one securement assembly that secures the modular housing portion and the modular lighting component(s) together. More specifically, the securement assembly (Continued)

may include at least one end plate that secures the modular housing portion and the separate modular lighting component(s) together.

11 Claims, 7 Drawing Sheets

(51) Int. Cl.
*F21Y 105/16* (2016.01)
*F21Y 115/10* (2016.01)

(56) References Cited

U.S. PATENT DOCUMENTS

2012/0113621 A1* 5/2012 Lee ..... F21V 5/10 362/97.1
2012/0206918 A1* 8/2012 Lee ..... F21S 2/005 362/249.02
2013/0176707 A1* 7/2013 Audette ..... F21V 13/14 362/84
2014/0085861 A1* 3/2014 Nicolai ..... F21V 13/14 362/84
2016/0327256 A1 11/2016 Hall
2017/0307145 A1* 10/2017 Hollander ..... F21S 8/033
2017/0307149 A1 10/2017 Clark et al.

OTHER PUBLICATIONS

PCT/GB2019/051360 International Search Report and Written Opinion dated Oct. 4, 2019.
GB1808092.9 Search Report dated Nov. 13, 2018.

* cited by examiner

LED LIGHTING FIXTURE

FIELD

The present disclosure relates generally to lighting fixtures, and more particularly to modular lighting fixtures utilizing light emitting diodes (LEDs) or other solid state light sources that are suitable for hazardous environments.

BACKGROUND

Lighting fixtures (e.g., luminaires) using LEDs or other solid-state light sources have in recent years become somewhat practical and continue to penetrate the lighting market due to the increased luminous efficacy of commercially available LED components. LED lighting systems can include one or more LED devices that become illuminated as a result of the movement of electrons through a semiconductor material. LED luminaires are desirable as they offer energy savings due to good luminous efficacy combined with the ability to precisely control light distribution patterns, which is of particular importance for certain lighting scenarios. Electrical components for powering and controlling LED luminaires are typically contained within an associated housing.

For instance, LED lighting fixtures can also include one or more LED driver circuits that are used to convert input power from an AC power source to a suitable driver current for powering LED arrays having one or more LED devices.

SUMMARY

Aspects and advantages of embodiments of the present disclosure will be set forth in part in the following description, or may be learned from the description, or may be learned through practice of the embodiments.

One example aspect of the present disclosure is directed to a lighting fixture. The lighting fixture can include a modular housing portion and one or more separate modular lighting components arranged adjacent to the modular housing portion. The separate modular lighting component(s) can include a lighting assembly having a plurality of LED devices and a plurality of optics. Each optic is secured relative to one of the plurality of LED devices. The lighting fixture also includes at least one securement assembly that secures the modular housing portion and the separate modular lighting component(s) together.

Other example aspects of the present disclosure are directed to lighting systems, light engines, lighting circuits, lighting fixtures, devices, and apparatuses according to example aspects of the present disclosure.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
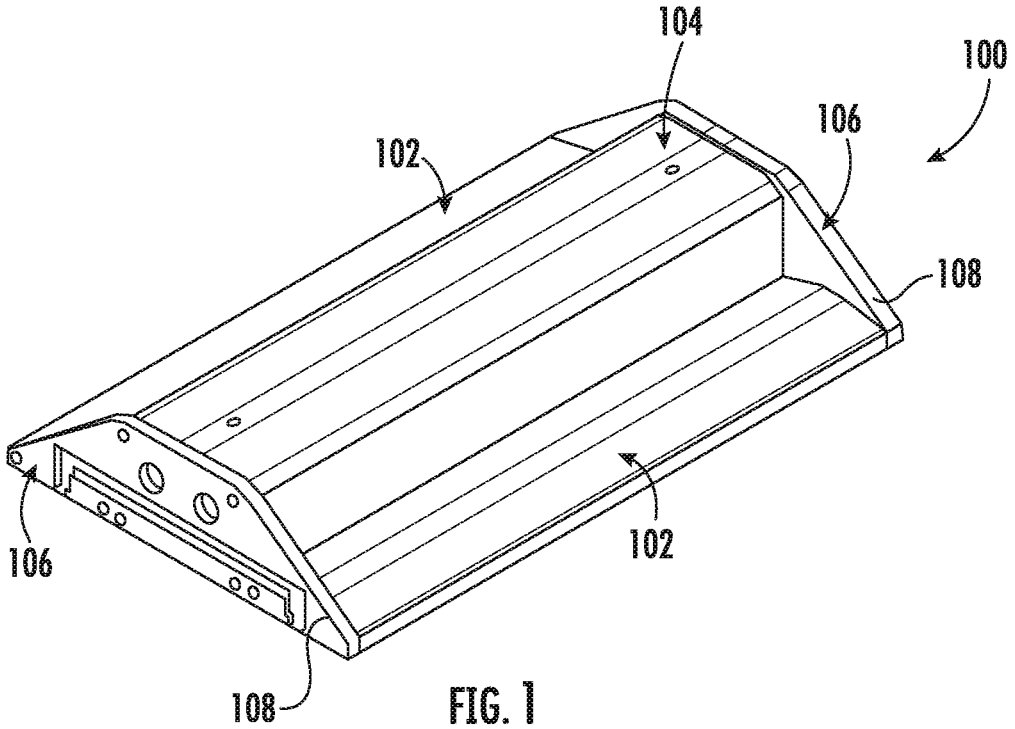
FIG. 1 depicts a perspective view of an example lighting fixture having a plurality of modular lighting components according to example embodiments of the present disclosure.
Figure 2:
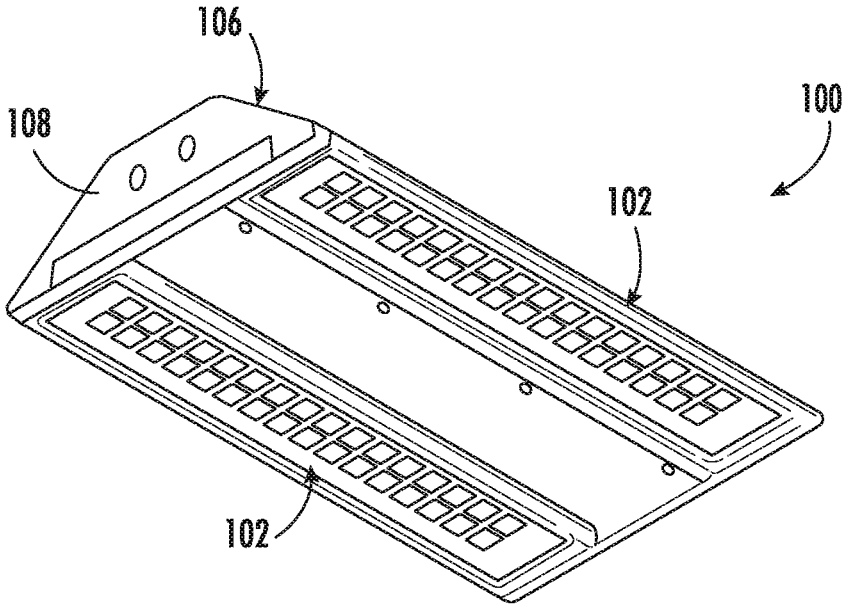
FIG. 2 depicts another perspective view of an example lighting fixture having a plurality of modular lighting components according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to a lighting fixture (e.g., an LED lighting fixture) having one or more modular components to make the lighting fixture readily adaptable to many different applications, such as for use in hazardous environments. For example, in certain embodiments, the lighting fixture may be rated for hazardous areas where an explosive gas atmosphere is likely to occur during normal operation or in a certain number of instances in a certain time period. For example, a hazardous environment may include areas having an explosive atmosphere of more than 10, but less than 1000 hours per year. In addition, hazardous areas may be generally defined as any place in which an explosive atmosphere may occur in quantities such as to require special precautions to protect the safety of workers. Accordingly, example aspects of the lighting fixture of the present disclosure may include a modular housing portion, one or more separate modular lighting components arranged adjacent to the modular housing portion, and a securement assembly for securing the modular components together. In example implementations, the modular housing portion of the lighting fixture may be a central modular housing portion. In addition, the modular housing portion may be configured to house one or more driver(s) as described herein.

In example aspects of the present disclosure, the number of modular lighting components of the lighting fixture can be selected or adjusted to adapt the lighting fixture to various different lighting applications. More specifically, in particular embodiments, the lighting fixture may include a single modular lighting component arranged on a single side of the modular housing portion. In further embodiments, the lighting fixture may include, at least, a first modular lighting component and a second modular lighting component. In such embodiments, the first and second modular lighting components may be arranged on opposite sides of the central modular housing portion. In an alternative embodiment, the first and second modular lighting components may be arranged on the same side of the central modular housing portion. In still further embodiments, the lighting fixture may include a plurality of first modular lighting components and a plurality of second modular lighting components. In such embodiments, the plurality of the first modular lighting components may be arranged on a first side of the central housing portion and the plurality of the second modular lighting components may be arranged on a second side of the central housing portion.

Accordingly, the lumen output of each of the modular lighting components can be combined to provide increased lumen output. In applications that may not require as high a lumen output or LED wattage, only a single modular lighting component can be mounted to the central housing portion. Further, the central housing portion can be readily adapted to be mounted in a variety of different manners (e.g., pole mount, wall mount, pendant mount, bracket mount) so that the lighting fixture is easily adaptable and in some cases convertible to many different lighting applications.

In further example aspects of the present disclosure, each of the modular lighting component(s) can include a lighting assembly having an LED module that contains a plurality of LED devices and a plurality of optics (e.g. such as silicone directional optics). More specifically, in such embodiments, each optic can be secured relative to one of the plurality of LED devices. In still further embodiments, each of the optics may be joined together via an optic frame assembly or gasket.

In additional example aspects of the present disclosure, the LED module is designed to allow for easy cleaning by reducing dust and dirt collection. For example, in one embodiment of the present disclosure, the modular lighting component(s) may include a sealed exterior housing having a sloped cross-section that prevents dust and/or dirt build up. In such embodiments, the sealed exterior housing may be formed of a first portion and a second portion mechanically secured together, e.g. via adhesive. Thus, the LED module as described herein can be a fully autonomous assembly that is sealed for the life of the package. In further example aspects of the present disclosure, the sealed exterior housing of the LED module may form a heat sink. In additional embodiments, the LED module may also include a potting material that is configured to at least partially fill an interior volume thereof. In other example aspects of the present disclosure, the LED module may have at least one end that each include one or more through holes configured to receive wiring from the driver(s) that powers the LED module.

Within the sealed exterior housing, the lighting assembly of the modular lighting component(s) may include an LED board that includes the plurality of LED devices and at least one fuse or diode mounted thereon. For example, in one embodiment, the LED devices may be arranged in at least two rows on the LED board, with the fuse(s) or diode(s) fitted between each of the LED devices. Thus, in such embodiments, the fuse(s) or diode(s) is configured to electrically couple each of the LED devices to the driver(s) within the modular housing portion and/or to each other. As such, in the case of an open circuit failure, the fuse(s) or diode(s) are configured to intercept the current such that the LED devices can continue to function properly. In another example aspect of the present disclosure, the LED module may further include one or more layers of thermal transfer tape adjacent to a bottom-side of the LED board opposite the plurality of LED devices.

In still further aspects of the present disclosure, the securement assembly may include at least one end plate configured to secure the modular housing portion and the modular lighting component(s) together. In further embodiments, the securement assembly may include opposing end plates, i.e. one at each end thereof. In additional embodiments, the end plate(s) may include a through channel for routing wiring from the driver(s) in the modular housing portion to each of the modular lighting components. In such embodiments, the through channel may extend length-wise within the end plate from the first modular lighting component across the central modular housing portion and to the second modular lighting component. In addition, in one embodiment, the lighting fixture may also include a channel cover arranged on an exterior side of one or both of the end plates so as to cover the through channel, thereby protecting the wiring therein. In still further embodiments, the end plate(s) may also include one or more through holes for receiving cable glands that route wiring from a power source to the driver(s) within the modular housing portion that powers the LED module. In other example implementations, the end plate(s) may also include one or more fastener holes for receiving fasteners to secure the end plate(s) to the modular housing portion and the modular lighting components(s), thereby securing the modular assembly together. In further example aspects of the present disclosure, the lighting fixture may also include a seal component (such as a gasket or O-ring seal) arranged at an interface between one of the end plates, the modular housing portion, and the modular lighting components.

Example aspects of the present disclosure are discussed with LED light sources for purposes of illustration and discussion. Those of ordinary skill in the art, using the disclosures provided herein, will understand that other suitable light sources (e.g., other solid-state light sources, fluorescent light sources, etc.) can be used without deviating from the scope of the present disclosure.

As used herein, a "lighting fixture" or "luminaire" refers to a device used to provide light or illumination using one or more light sources. The use of the term "about" when used in conjunction with a numerical value is intended to refer to within 25% of the stated numerical value. "Generally perpendicular" means within 20° of perpendicular.

One example aspect of the present disclosure is directed to a lighting fixture. The lighting fixture can include a modular housing portion and one or more separate modular lighting components arranged adjacent to the modular housing portion. The separate modular lighting component(s) can include a lighting assembly having a plurality of LED devices and a plurality of optics. Each optic is secured relative to one of the plurality of LED devices. The lighting fixture also includes at least one securement assembly that secures the modular housing portion and the separate modular lighting component(s) together.

In one embodiment, the modular housing portion may be a central modular housing portion. In another embodiment, the central modular housing portion may house one or more drivers.

In several embodiments, the one or more separate modular lighting components may include, at least, a first modular lighting component and a second modular lighting component. In such embodiments, the first and second modular lighting components may be arranged on opposite sides of the central modular housing portion. In alternative embodiments, the first and second modular lighting components may be arranged on the same side of the central modular housing portion. In further embodiments, the one or more separate modular lighting components may include a plurality of the first modular lighting components and a plurality of the second modular lighting component. In such embodiments, the plurality of the first modular lighting components may be arranged on a first side of the central housing portion, whereas the plurality of the second modular lighting components may be arranged on a second side of the central housing portion.

In additional embodiments, the securement assembly may include at least one end plate. In such embodiments, the end plate(s) may include a through channel for routing wiring from the one or more drivers in the central modular housing portion to each of the first and second modular lighting components. In addition, the through channel may extend length-wise from the first modular lighting component across the central modular housing portion and to the second modular lighting component. In further embodiments, the lighting fixture may include a channel cover arranged on an exterior side of the end plate(s) so as to cover the through channel.

In yet another embodiment, the end plate(s) may include one or more through holes for receiving one or more cable glands that route wiring from a power source to the one or more drivers. In particular embodiments, the end plate(s) may further include one or more fastener holes for receiving one or more fasteners for securing the end plate(s) to the modular housing portion and the one or more modular lighting components.

In certain embodiments, the lighting fixture may include a seal component arranged at an interface between the end plate(s), the modular housing portion, and/or the one or more modular lighting components.

In further embodiments, the modular lighting component(s) may include a sealed exterior housing. More specifically, in one embodiment, the sealed exterior housing may be a heat sink. In another embodiment, the sealed exterior housing may have a sloped cross-section. In certain embodiments, the sealed exterior housing may also include a potting material that at least partially fills an interior volume thereof. In yet another embodiment, the sealed exterior housing may include at least one end having one or more through holes that align with the through channel of the end plate(s) so as to receive the wiring from the one or more drivers.

In additional embodiments, the sealed exterior housing may include a first portion mechanically secured to a second portion. In such embodiments, the first and second portions of the sealed exterior housing may be mechanically secured together via at least one adhesive.

In still another embodiment, the lighting assembly of the one or more modular lighting components may also include an LED board that includes the plurality of LED devices and at least one of one or more fuses or diodes mounted thereon. As such, the fuse(s) and/or diode(s) electrically couple each of the plurality of LED devices to the one or more drivers. In certain embodiments, the plurality of LED devices may be arranged in at least two rows on the LED board, with at least one of the one or more fuses or diodes fitted between each of the plurality of LED devices of the at least two rows.

In several embodiments, the lighting fixture may also include thermal transfer tape adjacent to a bottom-side of the LED board opposite the plurality of LED devices. In further embodiments, each of the plurality of optics may be constructed of a plastic material. For example, in one embodiment, the plastic material may include silicone, such that each of the plurality of optics is a silicone directional optic. In yet another embodiment, each of the plurality of optics may be joined together via an optic frame assembly.

As such, the lighting fixture described herein is rated for hazardous areas where an explosive gas atmosphere is likely to occur a certain number of instances in a certain time period. In addition, the lighting fixture may be configured as a pole mount fixture, wall mount fixture, flood light fixture, pendant mount fixture, and/or another other suitable fixture.

Another example aspect of the present disclosure is directed to a modular light emitting diode (LED) assembly. The modular LED assembly includes a sealed exterior housing, an LED board housed within the exterior housing, a potting material at least partially filling an interior volume of the exterior housing, a plurality of LED devices mounted to the LED board, and at least one of one or more fuses or diodes mounted to the LED board. Further, at least one of the fuse(s) or diode(s) is configured to electrically couple each of the plurality of LED devices to each other and to one or more drivers. Moreover, the driver(s) provide current to the plurality of LED devices. The modular LED assembly further includes a plurality of optics arranged adjacent to the plurality of LED devices, with each optic secured relative to one of the plurality of LED devices. Thus, the sealed exterior housing secures the LED board, the plurality of LED devices, and the plurality of optics together. It should be further understood that the modular LED assembly may further include any of the additional features as described herein.

Still another example aspect of the present disclosure is directed to a securement assembly for securing a modular lighting fixture together. The modular lighting fixture has a modular housing portion and one or more modular lighting components arranged adjacent to the housing portion. The modular lighting component(s) have a lighting assembly that contains a plurality of LED devices and a plurality of optics. Each optic is secured relative to one of the plurality of LED devices. As such, the securement assembly includes at least one end plate having a through channel for routing wiring from one or more drivers in the modular housing portion to the one or more modular lighting components. For example, in one embodiment, the securement assembly may include opposing end plates positioned at opposing ends of the lighting fixture. Further, the through channel extends lengthwise across the one or more modular lighting components and the modular housing portion. It should be further understood that the securement assembly may further include any of the additional features as described herein.

Referring now to the drawings, FIGS. 1-13 depict various views of components of an example lighting fixture 100 according to example embodiments of the present disclosure. As will be discussed in more detail below, the lighting fixture 100 can include a plurality of modular components to readily adapt the lighting fixture 100 to a plurality of different lighting applications. More particularly, as shown in FIGS. 1-6, the lighting fixture 100 can include a plurality of modular lighting components 102 secured to a separate modular housing portion 104 via a securement assembly 106, which will be discussed in more detail herein.

In certain aspects of the present disclosure, the modular housing portion 104 may correspond to a central housing portion that secures and houses various components of the lighting fixture 100, such as electrical components, conductors, and other components of the lighting fixture 100. For example, as shown particularly in FIG. 6, the modular housing portion 104 may house a power circuit 112 for providing power to the modular lighting components 102. For instance, in certain embodiments, the power circuit 112 can include surge protective device(s), transformer(s), and/or driver(s) 113, 115 for converting an AC power to a DC power for energizing one or more LED devices 116 of the modular lighting components 102 as described herein. Example drivers can accept, for instance, an about a 100V to about a 277 V 50 Hz or 60 Hz AC input or an about a 347V to 480V 50 Hz or 60 Hz AC input. In some embodiments, the drivers can be dimmable drivers. The numbers, types, orientations, locations, configurations, etc. of the components of the power circuit 112 can be modified as needed depending on the lighting application of the lighting fixture 100. Additionally, and/or alternatively, the power circuit 112 can include more, less, and/or different components than shown. Other suitable power circuits can be used without deviating from the scope of the present disclosure. For instance, power circuits that do not make use of transformers can be used without deviating from the scope of the present disclosure.

It should also be understood that the modular housing portion 104 can be made from any suitable material, such as such as aluminum. In addition, other materials, such as die cast aluminum, stainless steel, galvanized steel, powder coated steel, or other material such as Glass Reinforced Plastic (GRP), can be used without deviating from the scope of the present disclosure. In further implementations, the modular housing portion 104 and/or the modular lighting components 102 can act as a thermal heat sink for heat generated by electrical components of the lighting fixture 100 by conducting heat away from heat generating sources within the housing portion 104 to the ambient.

Figure 3:
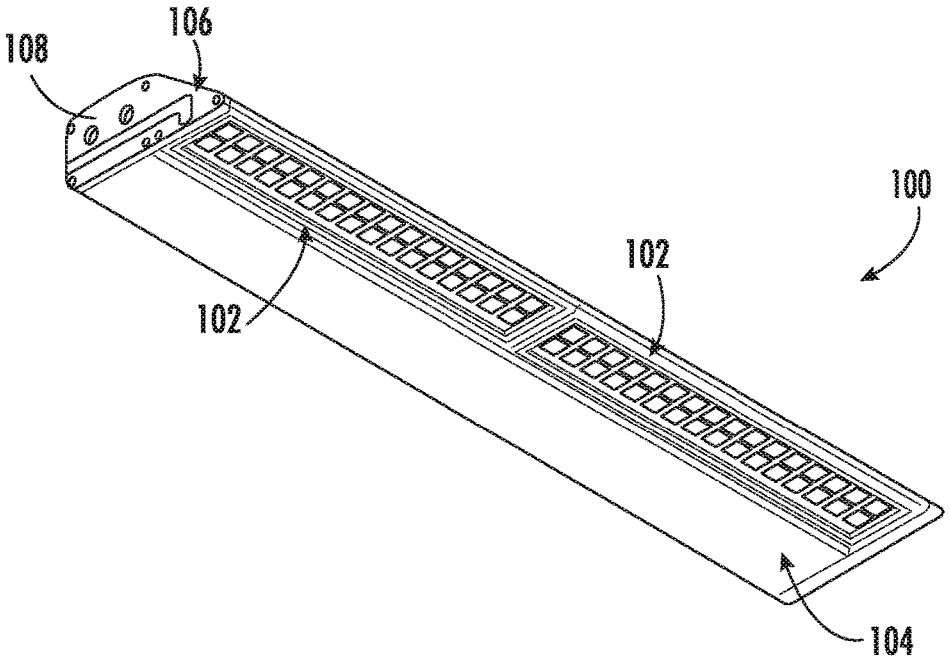
FIG. 3 depicts a perspective view of another example lighting fixture having a plurality of modular lighting components arranged on a single side of a central housing portion according to example embodiments of the present disclosure.
Figure 4:
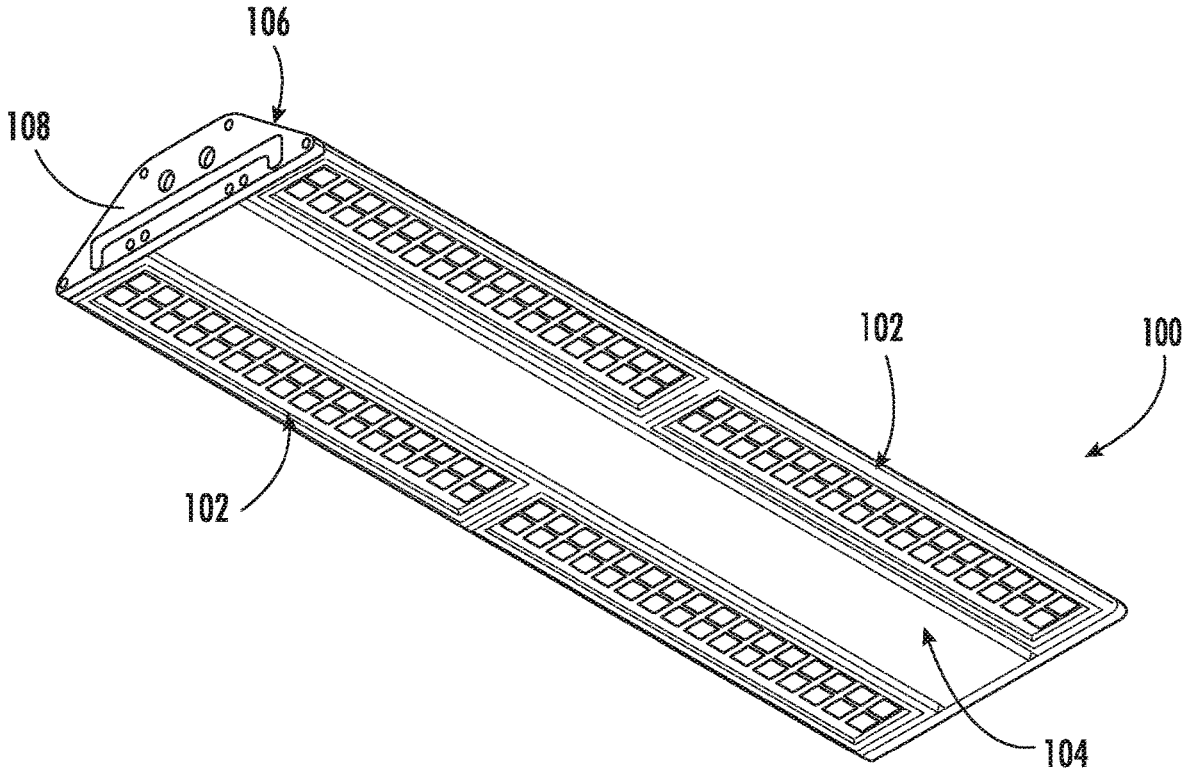
FIG. 4 depicts a perspective view of another example lighting fixture having a plurality of modular lighting components arranged on opposing sides of a central housing portion according to example embodiments of the present disclosure.
Figure 5:
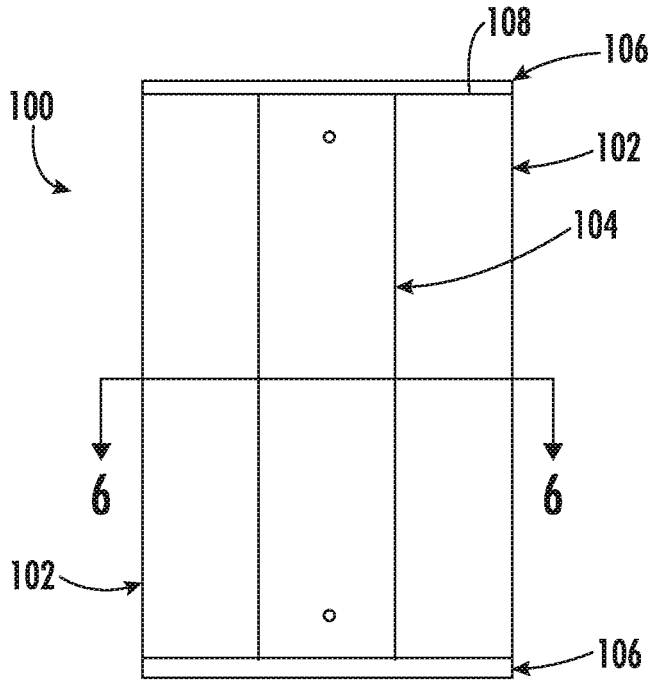
FIG. 5 depicts a top view of an example lighting fixture having a plurality of modular lighting components according to example embodiments of the present disclosure.

In particular implementations, the modular lighting components 102 can be arranged on opposing sides of the central housing portion 104 such that the modular lighting components 102 mirror one another. According to particular aspects of the present disclosure, more or fewer modular lighting components 102 can be mounted to the central housing portion 104. For instance, in further embodiments, the lighting fixture 100 can include only a single modular lighting component 102. Such a lighting fixture 100 can be suitable for applications requiring less lumen output relative to the lighting fixture 100 with two modular lighting components 102 shown in the illustrated figures. In some embodiments, as shown in FIG. 3, the lighting fixture 100 can include four modular lighting components 102. In such embodiments, as shown, two modular lighting components 102 can be arranged on each side of the central housing portion 104 in an end-to-end configuration. In alternative embodiments, as shown in FIG. 4, the modular lighting components 102 may be arranged on only one side of the housing portion 104. For example, as shown, two modular lighting components 102 are arranged in an end-to-end configuration on one side of the housing portion 104. It should be understood that any number of modular components 102 can be arranged in any suitable manner so as to extend a length of the overall lighting fixture 100, including a single modular lighting component or a plurality of lighting components.

Figure 12:
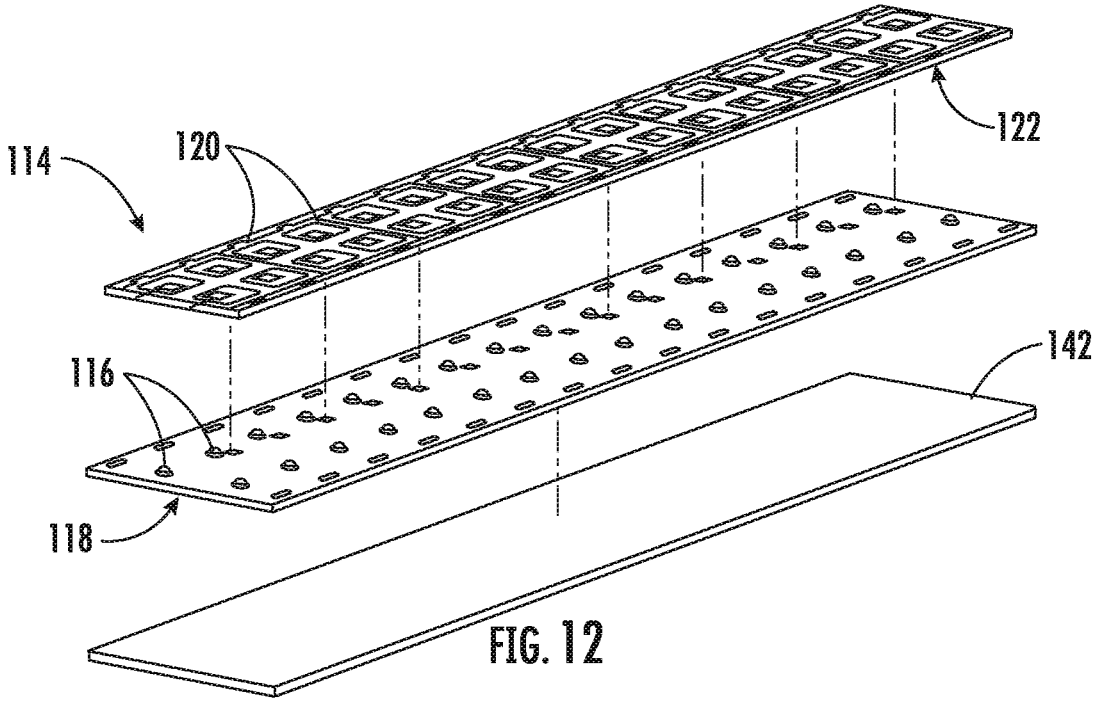
FIG. 12 depicts an exploded view of an example LED module of a lighting fixture according to example embodiments of the present disclosure.
Figure 13:
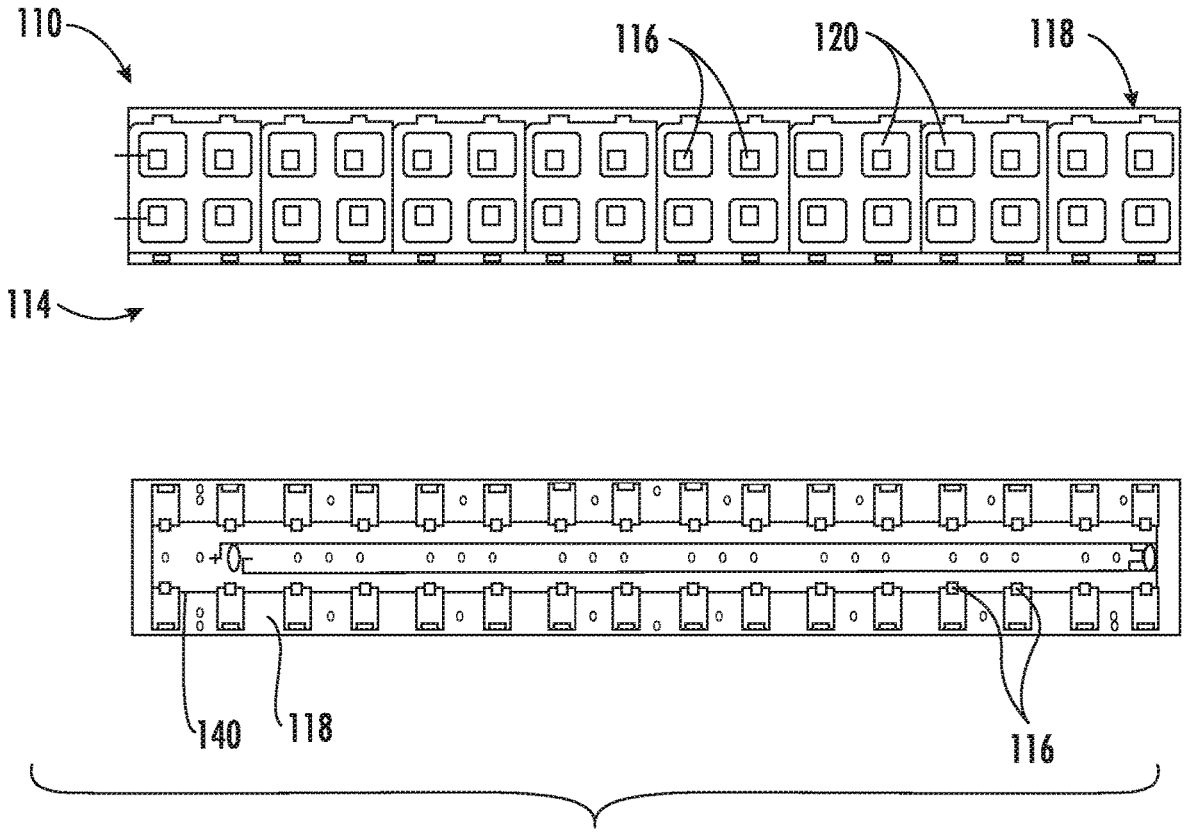
FIG. 13 depicts a top view of an example LED module of a lighting fixture according to example embodiments of the present disclosure.

Referring particularly in FIGS. 6-9 and 12-13, each modular lighting component 102 can include a sealed exterior housing 126 that contains a lighting assembly 110. More specifically, as shown, the lighting assembly 110 may include an LED light engine 114 (also referred to herein as an LED module) or other suitable system including a plurality of LED devices 116 mounted on an LED board 118. In addition, as shown particularly in FIG. 13, the LED module 114 may also include at least one fuse 140 or diode(s) mounted on the LED board 118. For example, as shown in the illustrated embodiment, the LED devices 116 may be arranged in a plurality of rows (e.g. two rows) on the LED board 118, with the fuse(s) 140 or diode(s) fitted between each of the LED devices 116. Thus, in such embodiments, the fuse(s) 140 is configured to electrically couple each of the LED devices 116 to the power circuit 112 and/or to each other. As such, in the case of an open circuit failure, the fuse(s) 140 or diode(s) can intercept the current such that the LED devices 116 can continue to function properly. In other example aspects of the present disclosure, as shown in FIG. 12, the LED module 114 may further include one or more layers of thermal transfer tape 142 adjacent to a bottom-side of the LED board 118 opposite the plurality of LED devices 116.

As such, the LED devices 116 can be configured to emit light as a result of movement of electrons through a semiconductor material. Further, the LED devices 116 can be of any suitable size, color, color temperature, etc. for desired light applications. For instance, in certain embodiments, the LED devices 116 can have a color temperature of, for instance, 3000K, 4000K, 5000K or other suitable color temperature. In addition, as shown, an optic 120 (e.g., a lens) can be positioned over or relative to each LED device 116. The optics 120 and/or arrangement of LED devices 116 can be configured to provide a variety of different light distributions, such as a type I distribution, type II distribution, type III distribution, type IV distribution, type V distribution (e.g., round, square, round wide, etc.) or other light distribution. More specifically, in certain embodiments, one or more of the optics 120 may correspond to silicone directional optics.

Figure 8:
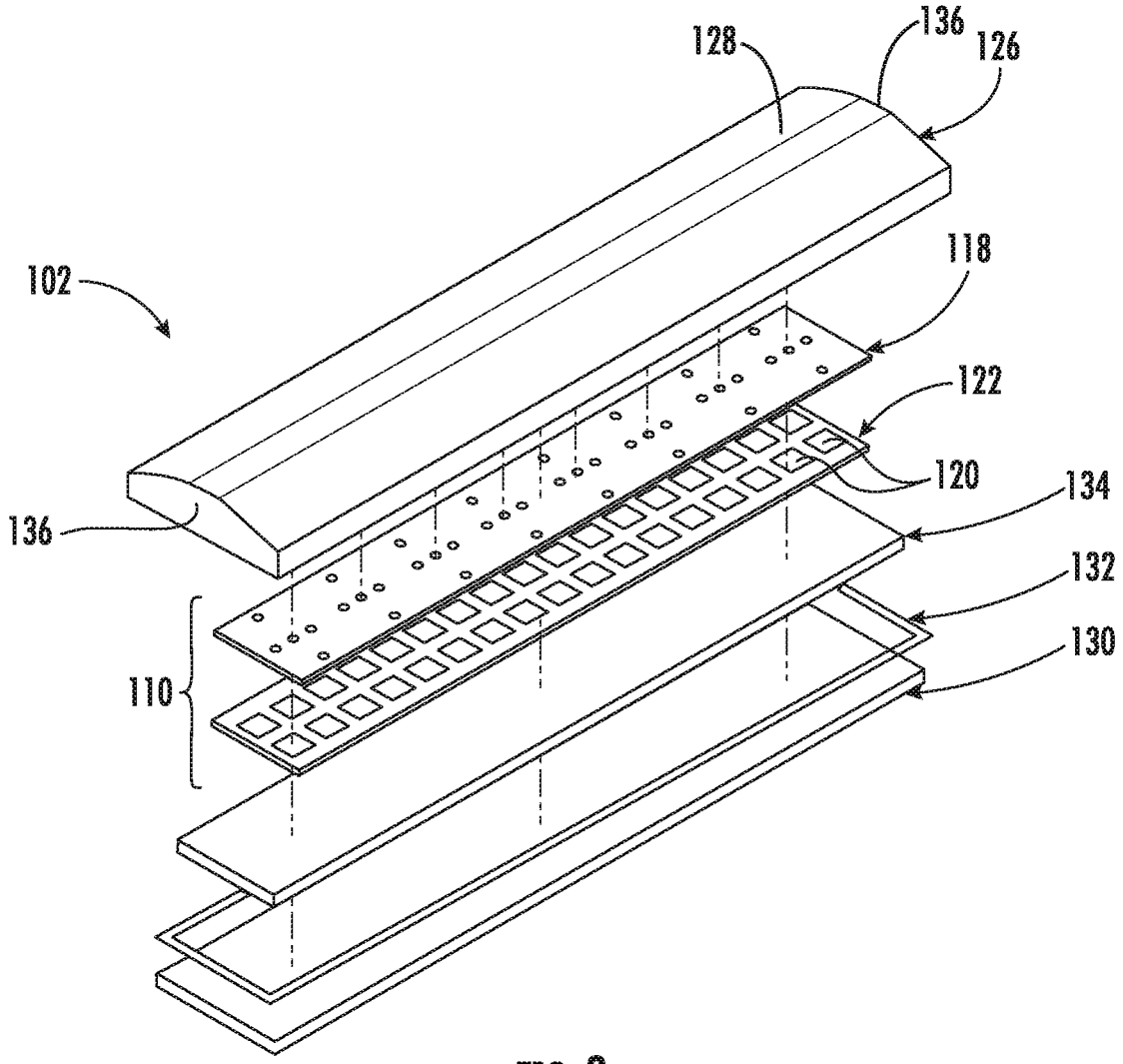
FIG. 8 depicts an exploded view of an example modular lighting component of a lighting fixture according to example embodiments of the present disclosure.

In still further embodiments, as shown in FIGS. 8 and 12, each of the optics 120 of the LED module 114 may be joined together via an optic frame assembly 122. For example, as shown, the optic frame assembly 122 may correspond to a gasket (e.g., a polyurethane gasket) that is placed over the optics 120 to ensure alignment of the optics 120 with the LED devices 116 and/or to weatherproof the LED light engine 114. In some implementations, the gasket can also aid in alignment in the direction perpendicular to the LED board 118, for instance, by pressing the optics 120 against the LED board 118.

In some implementations, the lighting fixture 100 can also include alignment pins that can be integral to the optics 120 and can fit into holes on the LED board 118 to aid lateral and traverse alignment of the optics 120.

Figure 6:
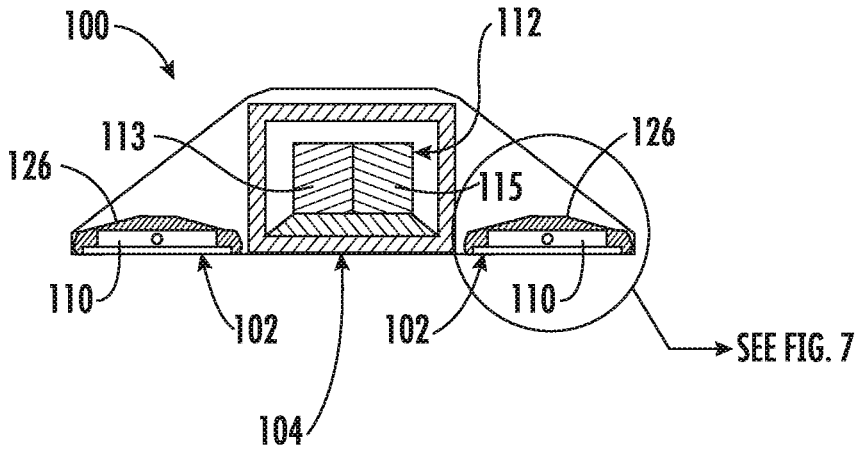
FIG. 6 depicts a cross-sectional view of the lighting fixture of FIG. 5 along line 6-6.
Figure 7:
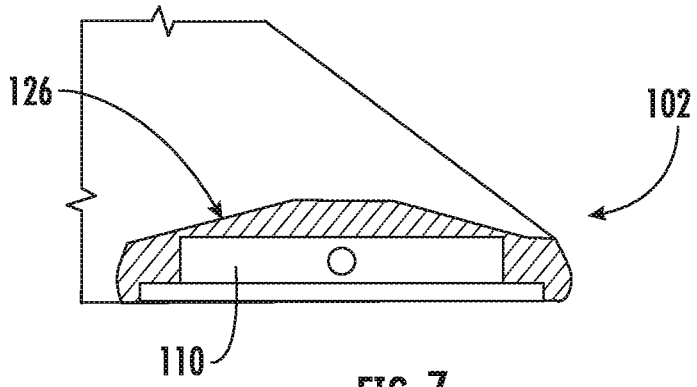
FIG. 7 depicts a detailed, cross-sectional view of a portion of the lighting fixture of FIG. 4.
Figure 9:
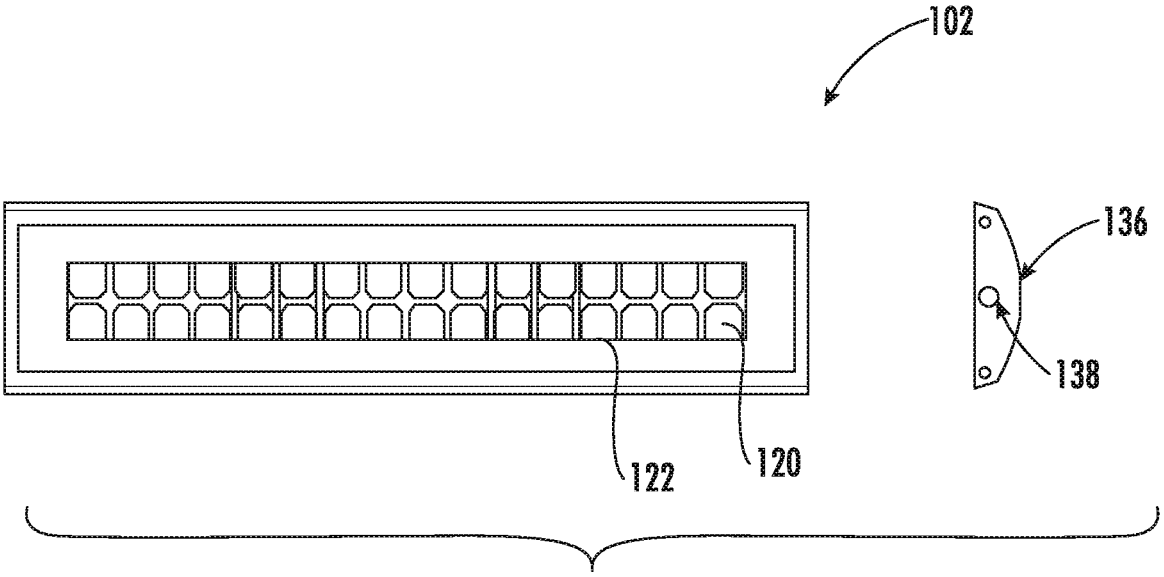
FIG. 9 depicts a top view of an example modular lighting component of a lighting fixture according to example embodiments of the present disclosure, particularly illustrating an end of the modular lighting component.

In additional example aspects of the present disclosure, as shown particularly in FIGS. 6-8, the LED module 114 is designed to allow for easy cleaning by reducing dust and dirt collection. For example, as shown in the illustrated embodiment, the modular lighting component(s) 102 may include a sealed exterior housing 126 having a sloped cross-section that prevents dust and/or dirt build up. In such embodiments, as shown particularly in FIG. 8, the sealed exterior housing 126 may be formed of one or more portions, including for example, a first portion 128 and a second portion 130 mechanically secured together, e.g. via adhesive 132. In addition, as shown in FIG. 9, the sealed exterior housing 126 of the LED module 114 may have at least one end 136 that may include one or more through holes 138 configured to receive wiring from the power circuit 112 (and therefore the associated drivers) that power the LED module 114. Thus, as mentioned, the LED module 114 as described herein can be a fully autonomous assembly that is sealed for the life of the package, thereby allowed the packages to be suitable for hazardous environments.

Referring particularly to FIG. 8, the sealed exterior housing 126 of the LED module 114 may also include a potting material 134 that is configured to at least partially fill an interior volume thereof so as to provide protection for any fault conditions. In certain embodiments, the potting material 134 described herein may correspond to any a solid or gelatinous compound that provides resistance to shock and/or vibration. In addition, the potting material 134 may prevent moisture and/or corrosive agents from entering the LED module 114. More specifically, in particularly embodiments, the potting material 134 may include thermosetting plastics and/or silicone rubber gels.

As mentioned, the lighting fixture 100 can also include a securement assembly 106 for securing the modular housing portion 104 and the modular lighting component(s) 102 together. For instance, in example implementations, as shown in FIGS. 1-5 and 10-11, the securement assembly 106 may include at least one end plate 108 configured to secure the modular housing portion 104 and the modular lighting component(s) 102 together. More specifically, as shown, the securement assembly 106 may include opposing end plates 108, i.e. one at each end of the lighting fixture 100.

Figure 10:
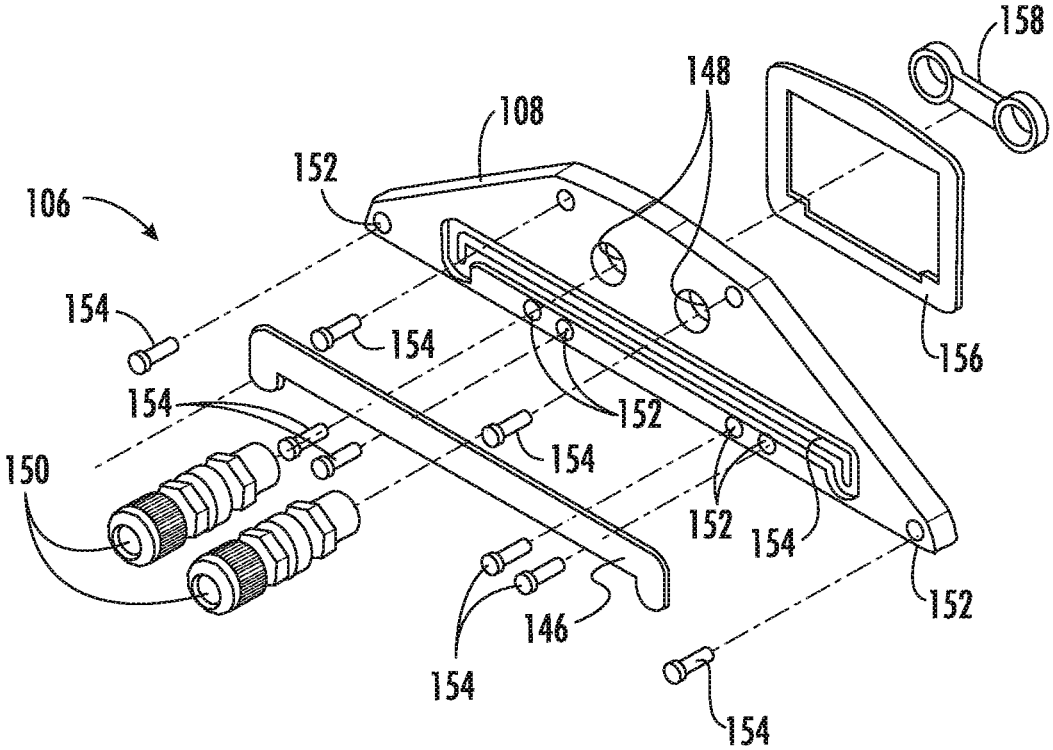
FIG. 10 depicts an exploded view of a securement assembly of a lighting fixture according to example embodiments of the present disclosure.
Figure 11:
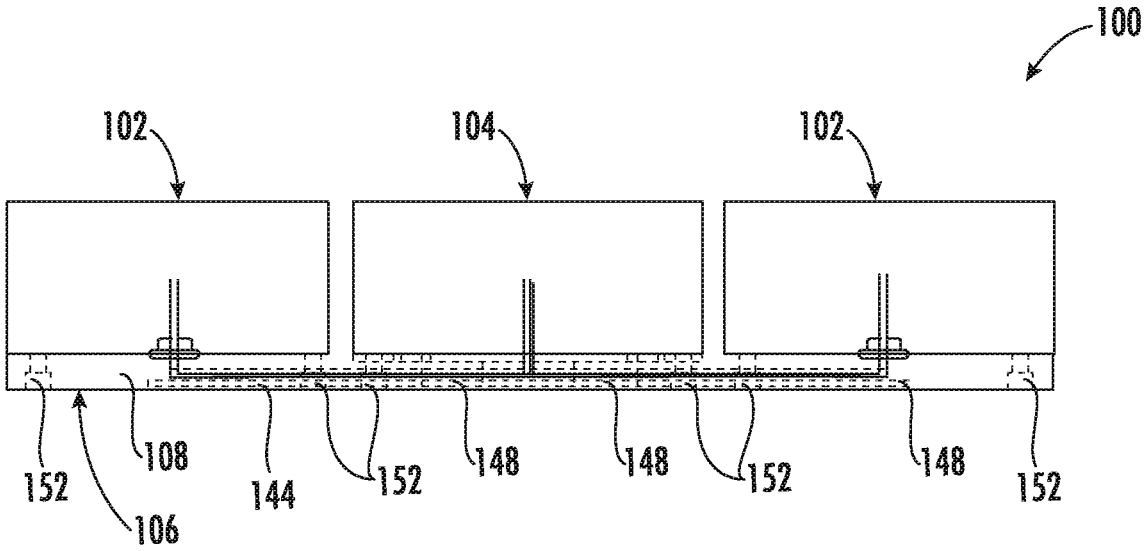
FIG. 11 depicts a front cross-sectional view of an example lighting fixture according to example embodiments of the present disclosure.

In additional embodiments, as shown particularly in FIGS. 1-5, the end plate(s) 108 may include a through channel 144 for routing wiring from the driver(s) 113, 115 of the power circuit 112 in the modular housing portion 104 to each of the modular lighting components 102. In example implementations, as shown, the through channel 144 may extend length-wise within the end plate 108 from the first modular lighting component 102 across the central modular housing portion 104 and to the second modular lighting component 102. Thus, the wiring from the driver(s) 113, 115 of the power circuit 112 in the modular housing portion 104 can be routed to each of the modular lighting components 102 via the through holes 138 thereof. In addition, as shown in FIG. 10, the lighting fixture 100 may also include a channel cover 146 arranged on an exterior side of one or both of the end plates 108 so as to cover the through channel 144 and the associated wiring therein. More specifically, as shown, the channel cover 146 may be sized to fit within a recess of the through channel 144 so as to not interfere with said wiring.

Still referring to FIG. 10, the end plate(s) 108 may also include one or more through holes 148 for receiving one or more cable glands 150 that route wiring from a power source (not shown) to the driver(s) 113, 115 of the power circuit 112 that power the LED module(s) 114. In such embodiments, the securement assembly 106 may further include one or more threaded receptacles 158 for receiving the cable glands 150 therein. The cable glands 150 can then be connected to the power circuit 112 in the modular housing portion 104. In other example implementations, as shown, the end plate(s) 108 may also include one or more fastener holes 152 for receiving fasteners 154 to secure the end plate(s) 108 to the modular housing portion 104 and the modular lighting components(s) 102, thereby securing the overall modular assembly together. In addition, as shown, the securement assembly 106 may also include a seal component 156 (such as a gasket or O-ring seal) arranged at an interface between one of the end plates 108, the modular housing portion 104, and the modular lighting components 102.

In further embodiments, the lighting fixture 100 can include one or more control devices for controlling various aspects of the lighting fixture. For instance, in some implementations, the lighting fixture 100 can include one or more motion sensors configured to detect motion in a space around the lighting fixture. When no motion is detected for a specified period of time, one more control devices (e.g., processors, controllers, microcontrollers, application specific integrated circuits) can control operation of the driver(s) or other devices (e.g., relays) to reduce or turn off the light output (e.g., operate at a lower wattage) of the lighting fixture 100. When motion is detected, the one or more control devices can control operation of the driver(s) or other devices to operate the lighting fixture 100 to provide its full light output or other preset level.

In some embodiments, the lighting fixture 100 can also include a wireless module coupled to each of the plurality of lighting assemblies 110. The wireless module can be used for communicating with a remote controller (e.g., computing device) over a wireless network. Control signals can be communicated to the lighting fixture 100 via the wireless module to control the driver(s), relays, and other devices, for instance, based on set time and date schedules that are programmed using a suitable user interface. The wireless module can also be used with communicating data and/or other information (e.g., operating parameters) to other devices over a network or direct peer to peer link.

The lighting fixture 100 can be mounted and configured in a variety of manners to provide illumination in a variety of different lighting applications. For example, the lighting fixture 100 may include an arm mount (not shown) mechanically coupled thereto. In such embodiments, the arm mount can be used to mount the lighting fixture 100 to a pole, a wall, or other suitable surface.

The example configurations illustrated in the figures are provided for purposes of illustration and discussion. Those of ordinary skill in the art, using the disclosures provided herein will understand that other example configurations can be generated using the lighting fixture 100 without deviating from the scope of the present disclosure.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

The invention claimed is:

1. A lighting fixture suitable for hazardous areas, comprising:

a modular housing portion;

one or more separate modular lighting components arranged adjacent to the housing portion, the one or more separate modular lighting components comprising a lighting assembly, the lighting assembly comprising a plurality of LED devices and a plurality of optics, each optic secured relative to one of the plurality of LED devices; and a securement assembly for securing the modular housing portion and the one or more separate modular lighting components together, wherein the modular housing portion is a central modular housing portion, the central modular housing portion housing one or more drivers and the one or more separate modular lighting components comprises, at least, a first modular lighting component and a second modular lighting component arranged on opposite sides of the central modular housing portion and, wherein further the securement assembly comprises at least one end plate, the at least one end plate comprising a through channel for routing wiring from the one or more drivers in the central modular housing portion to each of the first and second modular lighting components, the through channel extending length-wise from the first modular lighting component across the central modular housing portion and to the second modular lighting component.

2. The lighting fixture of claim 1, wherein the first and second modular lighting components are arranged on the same side of the central modular housing portion.

3. The lighting fixture of claim 1, wherein the one or more separate modular lighting components comprises a plurality of the first modular lighting components and a plurality of the second modular lighting components, the plurality of the first modular lighting components arranged on a first side of the central housing portion and the plurality of the second modular lighting components arranged on a second side of the central housing portion.

4. The lighting fixture of claim 1, further comprising a channel cover arranged on an exterior side of the at least one end plate so as to cover the through channel.

5. The lighting fixture of claim 4, wherein the at least one end plate further comprises at least one of one or more through holes for receiving one or more cable glands that route wiring from a power source to the one or more drivers or one or more fastener holes for receiving one or more fasteners for securing the at least one end plate to the modular housing portion and the one or more modular lighting components.

6. The lighting fixture of claim 5, wherein the one or more modular lighting components comprise a sealed exterior housing, the sealed exterior housing forming a heat sink, the sealed exterior housing further comprising a sloped cross-section.

7. The lighting fixture of claim 6, wherein the sealed exterior housing of the one or more modular lighting components further comprises a potting material at least partially filling an interior volume thereof.

8. The lighting fixture of claim 6, wherein the sealed exterior housing of the one or more modular lighting components further comprises a first portion mechanically secured to a second portion.

9. The lighting fixture of claim 5, wherein the lighting assembly of the one or more modular lighting components further comprises:

an LED board comprising the plurality of LED devices and at least one of one or more fuses or diodes mounted thereon, at least one of the one or more fuses or diodes electrically coupling each of the plurality of LED devices to the one or more drivers; and thermal transfer tape adjacent to a bottom-side of the LED board opposite the plurality of LED devices.

10. The lighting fixture of claim 1, further comprising a seal component arranged at an interface between the at least one end plate, the modular housing portion, and the one or more modular lighting components.

11. The lighting fixture of claim 1, wherein each of the plurality of optics comprises a silicone directional optics.

* * * * *